US009390662B2

(12) United States Patent
Kobayashi et al.

(10) Patent No.: US 9,390,662 B2
(45) Date of Patent: Jul. 12, 2016

(54) LIQUID CRYSTAL DISPLAY DEVICE

(71) Applicant: Panasonic Liquid Crystal Display Co., Ltd., Hyogo (JP)

(72) Inventors: Takahiro Kobayashi, Osaka (JP); Yoshio Umeda, Hyogo (JP); Hideki Abe, Hokkaido (JP); Takayuki Tajiri, Hokkaido (JP); Yoshihisa Ooishi, Osaka (JP); Shinji Yasukawa, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 392 days.

(21) Appl. No.: 13/724,912

(22) Filed: Dec. 21, 2012

(65) Prior Publication Data

US 2013/0169615 A1 Jul. 4, 2013

(30) Foreign Application Priority Data

Dec. 28, 2011 (JP) ..... 2011-288298

(51) Int. Cl.
*G09G 3/36* (2006.01)

(52) U.S. Cl.
CPC ..... *G09G 3/36* (2013.01); *G09G 3/3648* (2013.01); *G09G 3/3614* (2013.01); *G09G 2320/041* (2013.01); *G09G 2320/0626* (2013.01); *G09G 2360/16* (2013.01)

(58) Field of Classification Search
CPC ..... G09G 3/3426; G09G 3/36; G09G 3/3648; G09G 3/3614; G09G 3/3696; G09G 2320/041; G09G 2320/0626; G09G 2360/16
USPC ..... 345/87, 212
See application file for complete search history.

(56) References Cited

U.S. PATENT DOCUMENTS 5,748,171 A * 5/1998 Ishizaki et al. ..... 345/101
6,285,798 B1 * 9/2001 Lee ..... G06T 5/004 382/260
6,515,699 B2 * 2/2003 Tanji ..... H04N 5/202 348/254
RE39,742 E * 7/2007 Kasahara ..... G09G 3/2944 345/211
7,800,577 B2 * 9/2010 Kerofsky ..... G09G 3/3406 345/102
7,860,339 B2 * 12/2010 Yamashita ..... G06T 5/004 345/600
8,457,418 B2 * 6/2013 Jerdev ..... G06T 5/009 382/232
8,605,157 B2 * 12/2013 Kobayashi ..... G09G 5/10 348/189

(Continued)

FOREIGN PATENT DOCUMENTS

JP 2011-164288 8/2011

*Primary Examiner* — Matthew Fry
(74) *Attorney, Agent, or Firm* — Wenderoth, Lind & Ponack, L.L.P.

(57) ABSTRACT

A liquid crystal display device includes: a liquid crystal display unit that displays, for each of frames, an image based on an input image signal; a drive unit that applies a voltage based on the input image signal to pixels of the liquid crystal display unit; and a control unit that controls an amplitude of the voltage applied to the pixels. The drive unit applies, in one of the frames, a voltage of the same polarity to the pixels connected to one of the source signal lines. The control unit includes: a temperature-information acquiring unit that acquires temperature information of the drive unit; and a filter unit that acquires high-frequency and low-frequency components of the input image signal in a substantial extending direction of the source signal lines. The control unit controls the amplitude of the applied voltage using the temperature information and an output value of the high-frequency component.

5 Claims, 15 Drawing Sheets

(56) References Cited

U.S. PATENT DOCUMENTS

2003/0210829 A1* 11/2003 Someya ..... H04N 5/208 382/263
2005/0174438 A1* 8/2005 Nakakuki ..... H04N 7/0135 348/222.1
2006/0055829 A1* 3/2006 De Haan ..... H04N 5/202 348/675
2006/0284822 A1* 12/2006 Kerofsky et al. ..... 345/102
2008/0232708 A1* 9/2008 Erdler ..... G09G 3/2092 382/255
2008/0238860 A1* 10/2008 Onodera ..... 345/102
2008/0278473 A1* 11/2008 An ..... 345/214
2009/0310018 A1* 12/2009 Sakashita ..... G09G 3/3614 348/448
2010/0156772 A1* 6/2010 Arashima ..... G09G 3/3648 345/87
2010/0189373 A1* 7/2010 Ayzenberg ..... G06T 5/003 382/266
2011/0038018 A1* 2/2011 Kurigata ..... H04N 1/053 358/474
2012/0120096 A1* 5/2012 Johnson et al. ..... 345/596
2012/0299979 A1* 11/2012 Murai ..... G09G 3/3426 345/690

* cited by examiner

LIQUID CRYSTAL DISPLAY DEVICE

BACKGROUND

1. Technical Field

This disclosure relates to a liquid crystal display device that displays an image on a liquid crystal display unit.

2. Description of the Related Art

A liquid crystal display device is used as a high-definition color monitor of a computer or another information apparatus, or a display device of a television receiver. Basically, the liquid crystal display device includes a liquid crystal display unit in which liquid crystal is held between two substrates, at least one of which is made of transparent glass or the like. The liquid crystal display device includes a drive unit that selectively applies a voltage to various electrodes for pixel formation formed on the substrates of the liquid crystal display unit. The liquid crystal display device performs lighting and extinguishing of predetermined pixels according to the voltage application by the drive unit. The liquid crystal display device is excellent in contrast performance and high-speed display performance.

In general, the liquid crystal display unit includes a plurality of gate signal lines, a plurality of source signal lines, and a plurality of pixels. Each of the plurality of gate signal lines is provided to extend in the lateral direction (a main scanning direction) for example, and provided side by side in the longitudinal direction (a sub-scanning direction). Each of the plurality of source signal lines are provided to extend in the longitudinal direction (the sub-scanning direction) for example, and provided side by side in the lateral direction (the main scanning direction). A plurality of thin film transistors (TFTs) and a plurality of pixels are arranged in a matrix at crossing points of the plurality of gate signal lines and the plurality of source signal lines.

The drive unit applies a voltage for turning on and off the TFTs to the gate signal lines. The drive unit applies a voltage based on an image signal to the source signal lines to change the transmittance of the liquid crystal to a value corresponding to the applied voltage. At this point, the drive unit retains the image signal for one horizontal period and outputs the image signal to the source signal lines of the liquid crystal display unit. As shown in FIG. 18, the source signal line of the liquid crystal display unit is represented by an equivalent circuit including a wiring resistor, a gate capacitor of the TFT, a capacitor between wiring layers, and a capacitor between the wiring layer and another liquid crystal layer. Therefore, when an input image signal changes for each one horizontal period, charging and discharging for the capacitors are repeated. Thus, a current amount supplied from the drive unit increases, whereby the temperature of the drive unit rises. When the temperature of the drive unit exceeds a guarantee temperature for guaranteeing the operation of the drive unit, this leads to deterioration in characteristics of the drive unit. Therefore, in a technique described in Japanese Patent Application Publication No. 2011-164288 for example, it is detected whether the temperature of a chip constituting the drive unit rises to temperature equal to or higher than a predetermined temperature and a maximum output voltage of a gamma correction voltage is reduced on the basis of a detection result, whereby the amplitude of an applied voltage from the drive unit to pixels is reduced.

As it is seen from FIG. 18, when the input image signal does not change for each one horizontal period, since charging and discharging for the capacitors are not performed, the temperature of the drive unit does not rise. In other words, when the application of the maximum output voltage of the gamma correction voltage is continued, it is unnecessary to reduce the amplitude. However, in the technique described in above-mentioned Japanese Patent Application Publication No. 2011-164288, the maximum output voltage of the gamma correction voltage is reduced irrespective of a change in the input image signal. Therefore, even when it is unnecessary to reduce the amplitude, the amplitude of the applied voltage from the drive unit to the pixels is reduced. Therefore, in the technique described in above-mentioned Japanese Patent Application Publication No. 2011-164288, it is difficult to suitably control the amplitude of the applied voltage from the drive unit to the pixels according to the change in the input image signal.

SUMMARY

In one general aspect, the instant application describes a liquid crystal display device that includes: a liquid crystal display unit that includes a plurality of source signal lines, a plurality of gate signal lines, and a plurality of pixels connected to the source signal lines and the gate signal lines, and displays, for each of frames, an image based on an input image signal; a drive unit that applies a voltage based on the input image signal to the plurality of pixels of the liquid crystal display unit; and a control unit that controls an amplitude of the voltage applied to the plurality of pixels by the drive unit. The drive unit applies, in one of the frames, a voltage of the same polarity to the plurality of pixels connected to one of the source signal lines, the control unit includes: a temperature-information acquiring unit that acquires temperature information corresponding to a temperature of the drive unit; and a filter unit that acquires a high-frequency component of the input image signal in a substantial extending direction of the source signal lines, and the control unit controls the amplitude of the voltage applied to the plurality of pixels by the drive unit using the temperature information of the drive unit acquired by the temperature-information acquiring unit and an output value of the high-frequency component acquired by the filter unit.

The filter unit that acquires the high-frequency component and the low-frequency component of the input image signal in the substantial extending direction of the source signal lines is used. Therefore, it is possible to suitably control the amplitude of the applied voltage to the pixels according to a change in the input image signal.

DETAILED DESCRIPTION (First Embodiment)

Figure 1:
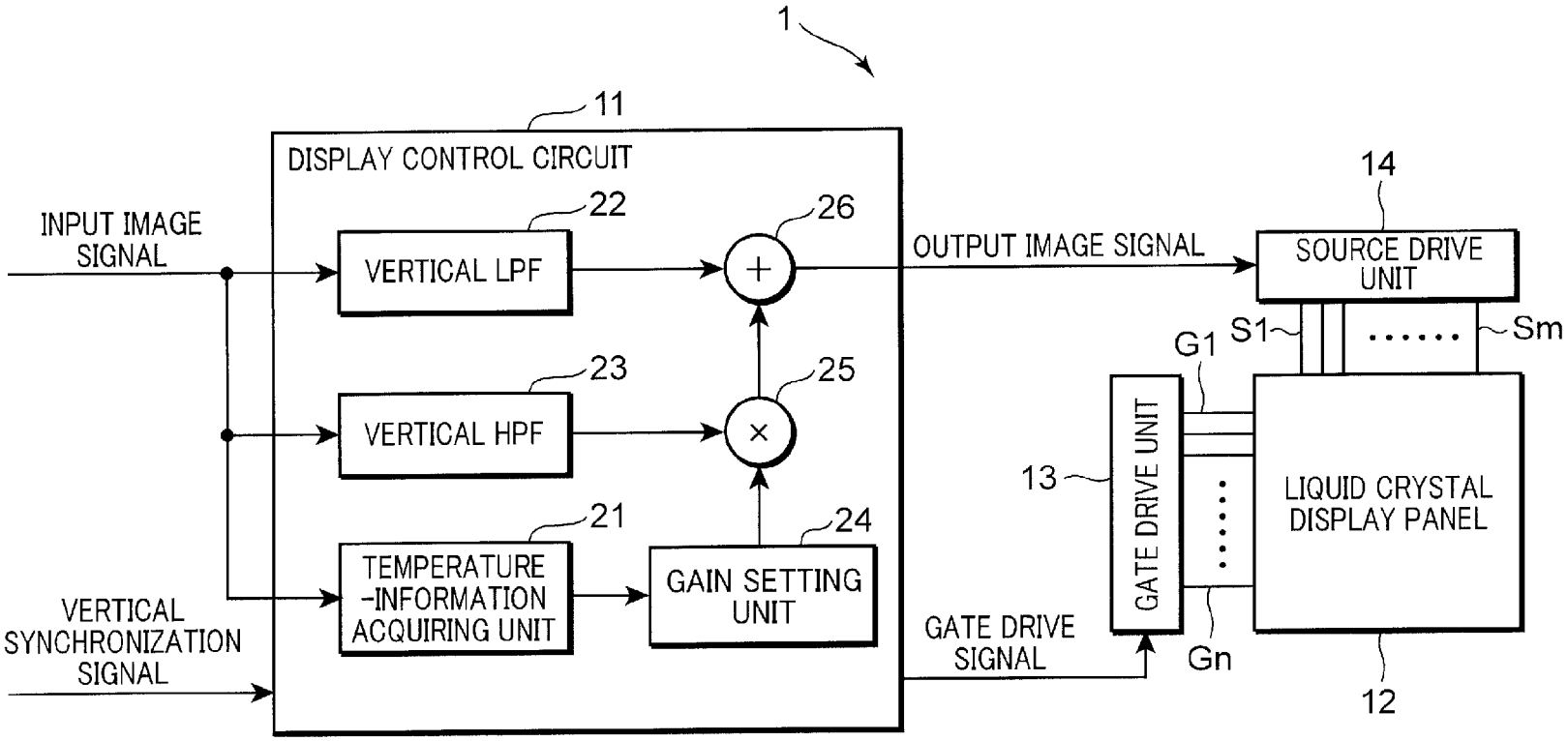
FIG. 1 is a block diagram showing a configuration of a liquid crystal display device according to a first embodiment of the instant application.
Figure 2:
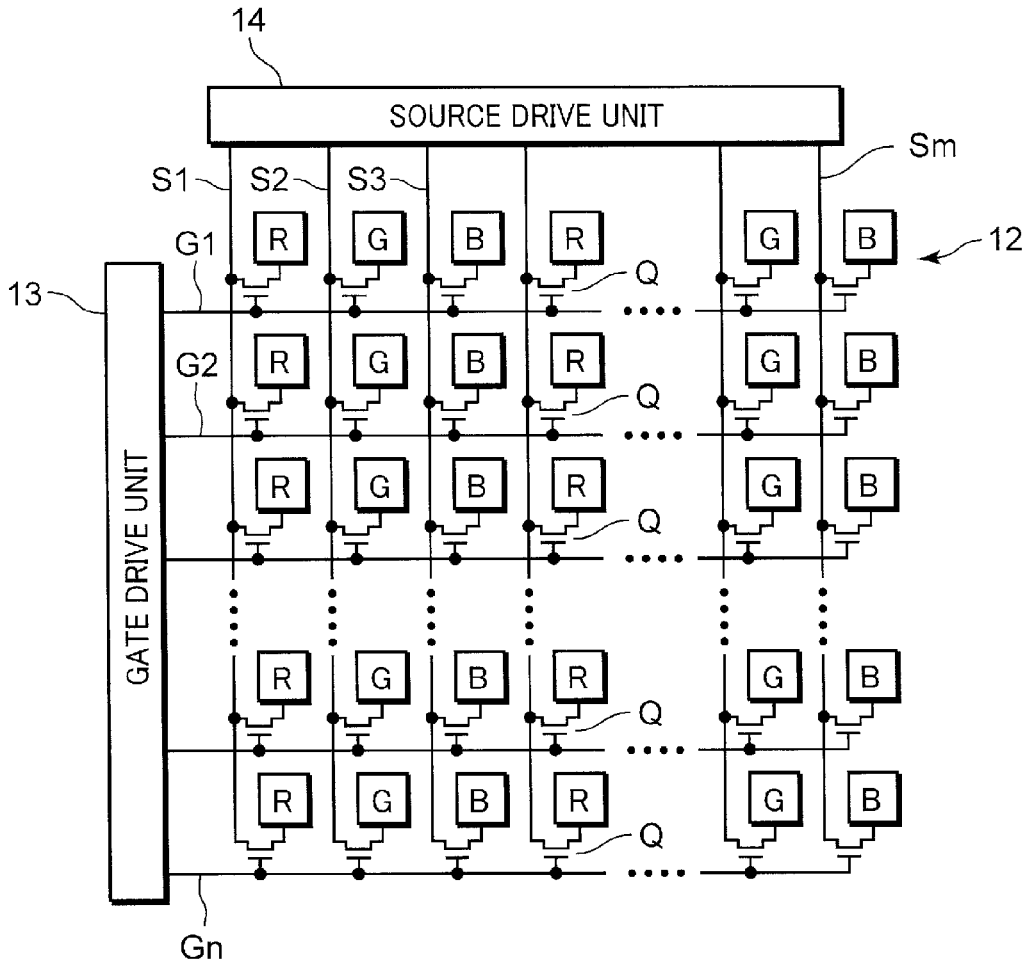
FIG. 2 is a circuit diagram showing a connection state of signal lines of a liquid crystal display panel shown in FIG. 1.

FIG. 1 is a block diagram showing a configuration of a liquid crystal display device according to a first embodiment of the instant application. FIG. 2 is a circuit diagram showing a connection state of signal lines of a liquid crystal display panel shown in FIG. 1. As shown in FIG. 1, a liquid crystal display device 1 includes a display control circuit 11, a liquid crystal display panel 12, a gate drive unit 13, and a source drive unit 14.

The liquid crystal display panel 12 includes, as shown in FIG. 2, a plurality of source signal lines S1, S2, . . . , and Sm, a plurality of gate signal lines G1, G2, . . . , and Gn, a plurality of thin-film transistors Q, and a plurality of pixels R, G, and B (i.e., red pixels R, green pixels G, and blue pixels B; hereinafter simply referred to as "pixels R, G, and B"). The plurality of source signal lines S1, S2, . . . , and Sm extend in the longitudinal direction (a sub-scanning direction) and are provided side by side in the lateral direction (a main scanning direction). The plurality of gate signal lines G1, G2, . . . , and Gn extend in the lateral direction (the main scanning direction) and are provided side by side in the longitudinal direction (the sub-scanning direction). The plurality of thin-film transistors Q and the plurality of pixels R, G, and B are arranged in a matrix at crossing points of the plurality of source signal lines S1, S2, . . . , and Sm and the plurality of gate signal lines G1, G2, . . . , and Gn.

The display control circuit 11 controls the gate drive unit 13 and the source drive unit 14 on the basis of an input image signal and a vertical synchronization signal to write, for each of frames, image data once in the pixels arranged in a matrix of the liquid crystal display panel 12. The gate drive unit 13 applies a scanning voltage to the gate signal lines G1, G2, . . . , and Gn to select the gate signal lines G1, G2, . . . , and Gn in order from the top to the bottom to turn on the thin-film transistors Q of the corresponding gate signal lines G1, G2, . . . , and Gn. The source drive unit 14 applies, via the source signal lines S1, S2, . . . , and Sm, a voltage corresponding to the image data to the pixels R, G, and B corresponding to the gate signal lines G1, G2, . . . , and Gn selected by the gate drive unit 13 (i.e., the thin-film transistors Q of which are turned on). Consequently, the voltage corresponding to the image data is applied to liquid crystal layers of the pixels R, G, and B and the transmittance of the pixels R, G, and B is controlled.

The selection of the gate signal lines G1, G2, . . . , and Gn by the gate drive unit 13 is completed from the top to the bottom, whereby the image data is written in all the pixels once on the basis of the input image signal and the vertical synchronization signal. An image for one frame is generated by the writing of the image data in all the pixels. The liquid crystal display panel 12 is a display unit of a hold type that holds the written image data for one frame period until writing of the next image data.

Image generation for one frame is repeated at a predetermined frame frequency by the display control circuit 11, whereby an image displayed on the liquid crystal display panel 12 is viewed by a viewer. As the liquid crystal display panel 12, an in plane switching (IPS) system, a vertical alignment (VA) system, and any other systems may be applied.

Figure 3:
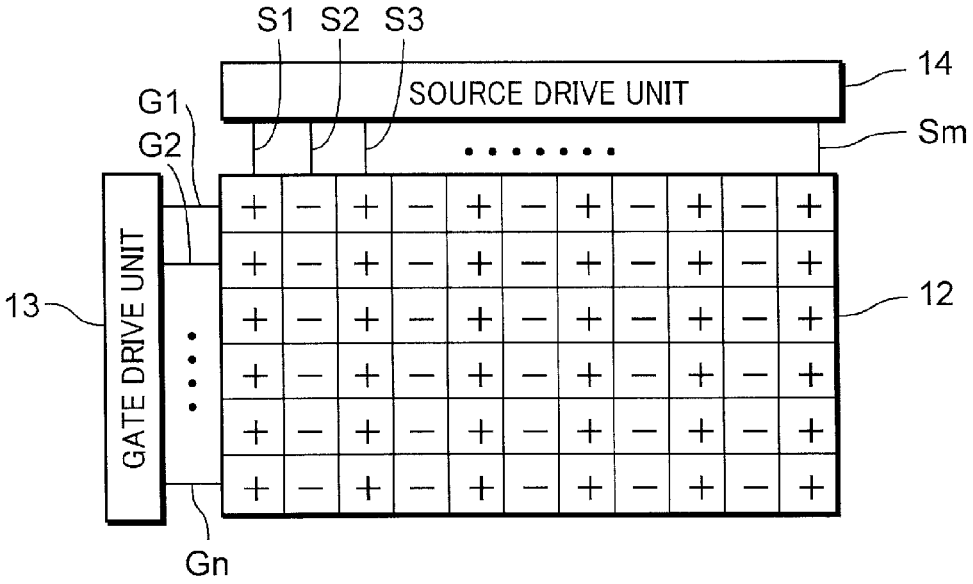
FIG. 3 is a diagram showing the polarity of an applied voltage to pixels in a certain frame in the liquid crystal display panel shown in FIG. 1.
Figure 4:
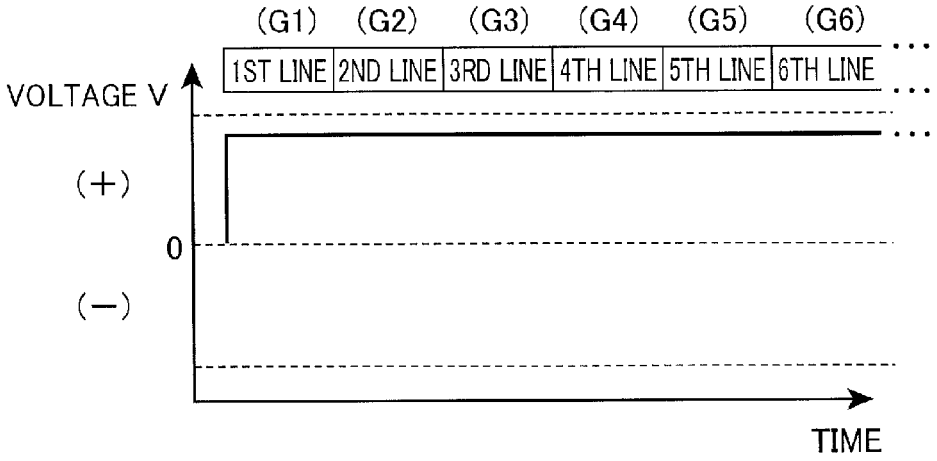
FIG. 4 is a diagram showing an applied voltage to source signal lines when a white image is displayed over the entire surface of the liquid crystal display panel.

FIG. 3 is a diagram showing the polarity of an applied voltage to the pixels in a certain frame in the liquid crystal display panel shown in FIG. 1. FIG. 4 is a diagram showing an applied voltage to the source signal lines when a white image is displayed over the entire surface of the liquid crystal display panel.

In general, it is known that, in a liquid crystal display panel, when a direct-current driving voltage is applied to pixels in order to drive the pixels, liquid crystal is deteriorated to shorten the life of the liquid crystal and, as a result, display quality is deteriorated. Therefore, in the liquid crystal display panel 12, alternating-current (AC) voltage driving, in which, for each of frames, the polarity of a voltage applied to the pixels is inverted, is performed. Further, in the liquid crystal display panel 12 in this embodiment, as shown in FIG. 3, in respective frames, the polarities of voltages applied to the same source signal line are set the same and the polarities of voltages applied to adjacent source signal lines are alternately set to different polarities.

Therefore, as shown in FIG. 3 for example, in a certain frame, when the polarity of an applied voltage to the source signal line S1 is set to "+", the polarity of an applied voltage to the source signal line S2 is set to "−" and the polarity of an applied voltage to the source signal line S3 is set to "+". In the next frame of the frame shown in FIG. 3, the polarity of an applied voltage to the source signal line S1 is set to "−", the polarity of an applied voltage to the source signal line S2 is set to "+", and the polarity of an applied voltage to the source signal line S3 is set to "−". In this way, column inversion driving is performed in the liquid crystal display panel 12 of this embodiment.

Further, in the frame shown in FIG. 3 for example, an applied voltage to the source signal line S1 is set to the same "+" polarity. Therefore, when a white image is displayed over the entire surface of the liquid crystal display panel 12, as shown in FIG. 4, even if the gate signal lines G1, G2, and the like to be selected change, a voltage at the same level is applied with the same polarity. Thus, since charging and discharging do not occur in the thin-film transistors Q, current supply from the source drive unit 14 to the thin-film transistors Q is suppressed. As a result, since power consumption in the source drive unit 14 is reduced, it is possible to suppress a temperature rise of the source drive unit 14.

Referring back to FIG. 1, the display control circuit 11 includes a temperature-information acquiring unit 21, a vertical low-pass filter (LPF) 22, a vertical high-pass filter (HPF) 23, a gain setting unit 24, a multiplier 25, and an adder 26. The temperature-information acquiring unit 21 acquires temperature information corresponding to the temperature of the source drive unit 14. In this embodiment, the temperature-information acquiring unit 21 estimates the temperature of the source drive unit 14 on the basis of the amplitude and the frequency of an input image signal, and acquires the estimated temperature as temperature information of the source drive unit 14. The temperature-information acquiring unit 21 outputs the acquired temperature information to the gain setting unit 24. Alternatively, the temperature-information acquiring unit 21 may include a temperature sensor that detect the temperature of the source drive unit 14 and acquire a detected temperature by the temperature sensor as temperature information of the source drive unit 14.

The vertical LPF 22 extracts and outputs a low-frequency component in the vertical direction (i.e., the direction in which the source signal lines S1, S2, . . . , and Sm extend in FIG. 2) of the input image signal. The vertical HPF 23 extracts and outputs a high-frequency component in the vertical direction (i.e., the direction in which the source signal lines S1, S2, . . . , and Sm extend in FIG. 2) of the input image signal. The gain setting unit 24 sets a gain on the basis of the temperature information of the source drive unit 14 output from the temperature-information acquiring unit 21 and outputs the set gain to the multiplier 25. Functions of the vertical LPF 22, the vertical HPF 23, and the gain setting unit 24 are further described below.

The multiplier 25 multiplies an output value of the high-frequency component in the vertical direction of the input image signal output from the vertical HPF 23 by the gain output from the gain setting unit 24 and outputs a multiplication result to the adder 26. The adder 26 adds an output value of the low-frequency component in the vertical direction of the input image signal output from the vertical LPF 22 and the multiplication result output from the multiplier 25, and outputs an addition result to the source drive unit 14 as an output image signal.

Figure 5:
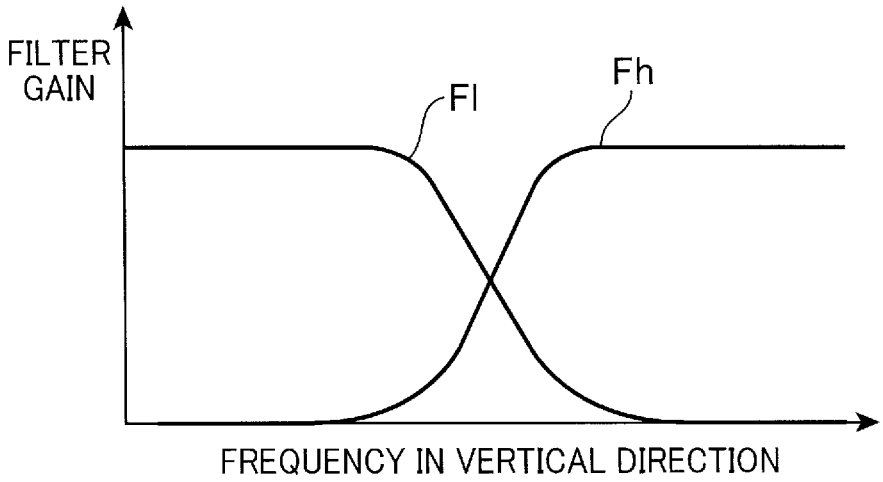
FIG. 5 is a diagram showing an example of frequency characteristics of a vertical LPF and a vertical HPF.
Figure 6:
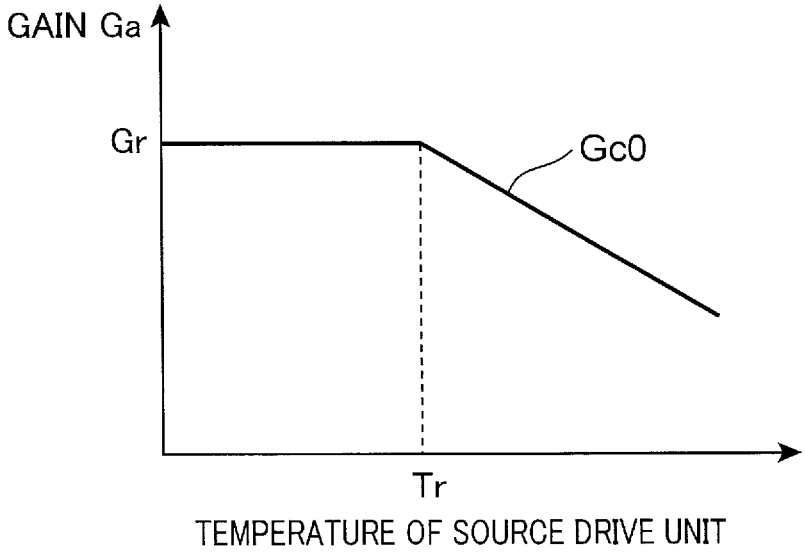
FIG. 6 is a diagram showing an example of a gain curve retained by a gain setting unit.

FIG. 5 is a diagram showing an example of frequency characteristics of the vertical LPF 22 and the vertical HPF 23. FIG. 6 is a diagram showing an example of a gain curve retained by the gain setting unit 24.

A frequency characteristic Fl of the vertical LPF 22 and a frequency characteristic Fh of the vertical HPF 23 shown in FIG. 5 are determined such that an input image signal and an output image signal are equal when a gain is set to a reference gain Gr (e.g., Gr=1) in the gain setting unit 24. As the vertical LPF 22, a "1:2:1" digital filter is used in this embodiment, for example. As the vertical HPF 23, a "−1:2:−1" digital filter is used in this embodiment, for example.

The gain setting unit 24 retains a gain curve Gc0 shown in FIG. 6. The gain curve Gc0 is set in advance to correspond to the temperature of the source drive unit 14. When temperature information of the source drive unit 14 output from the temperature-information acquiring unit 21 indicates that the temperature of the source drive unit 14 is lower than a reference temperature Tr (e.g., Tr=70° C.) set in advance, the gain setting unit 24 sets the gain Ga to the reference gain Gr (e.g., Gr=1). When the temperature information of the source drive unit 14 output from the temperature-information acquiring unit 21 indicates that the temperature of the source drive unit 14 is equal to or higher than the reference temperature Tr (e.g., Tr=70° C.) set in advance, the gain setting unit 24 reduces the gain Ga from the reference gain Gr as shown in FIG. 6. In FIG. 6, the gain Ga is linearly reduced in a range of temperature equal to or higher than the reference temperature Tr, but this is not limiting. For example, the gain Ga may be reduced stepwise in a range of temperature equal to or higher than the reference temperature Tr. In this embodiment, the liquid crystal display panel 12 corresponds to an example of the liquid crystal display unit, the source drive unit 14 corresponds to an example of the drive unit, the display control circuit 11 corresponds to an example of the control unit, and the vertical LPF 22 and the vertical HPF 23 correspond to an example of the filter unit. In this embodiment, the multiplier 25 corresponds to an example of the multiplying unit and the adder 26 corresponds to an example of the adding unit.

Figure 7:
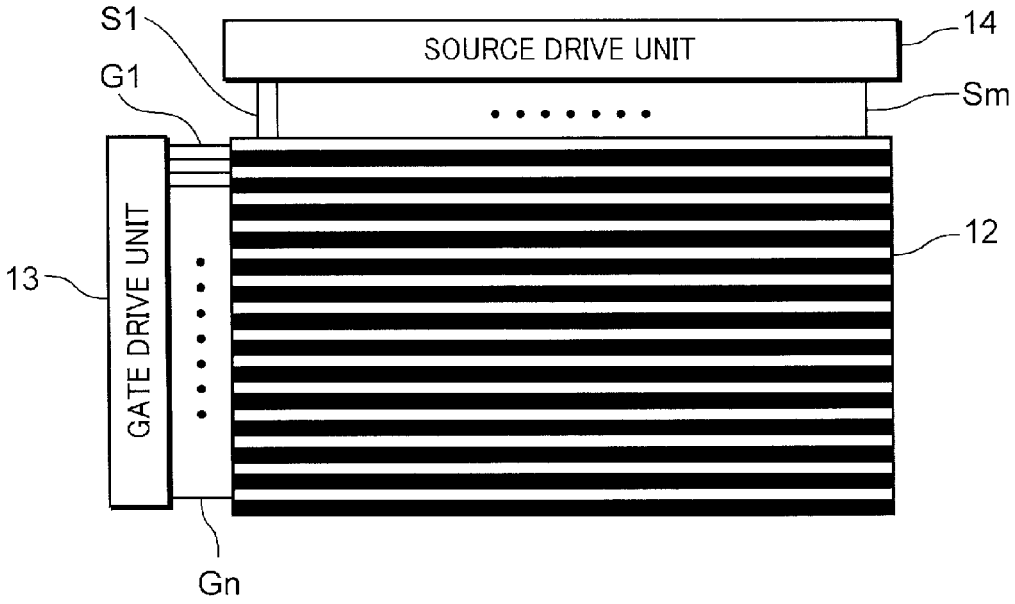
FIG. 7 is a diagram showing a state in which white images and black images are alternately displayed on the liquid crystal display panel for each one line in the horizontal direction.
Figure 8:
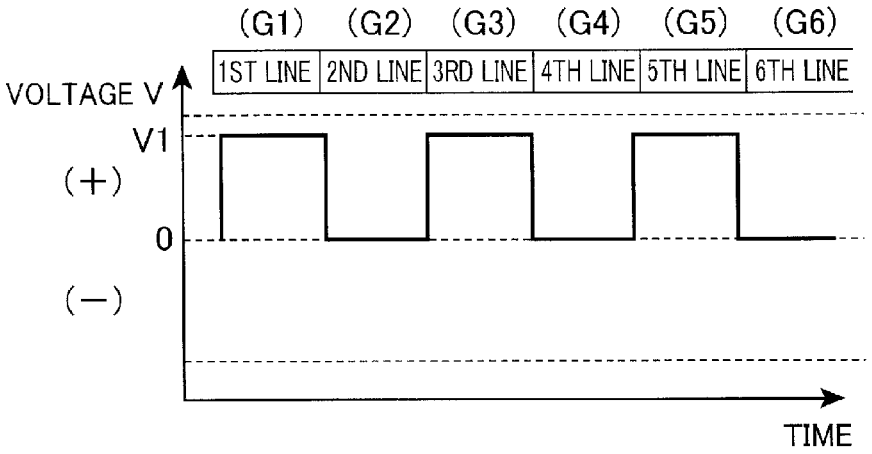
FIG. 8 is a diagram showing a voltage waveform applied to the source signal lines when a gain is set to a reference gain by the gain setting unit in the state shown in FIG. 7.
Figure 9:
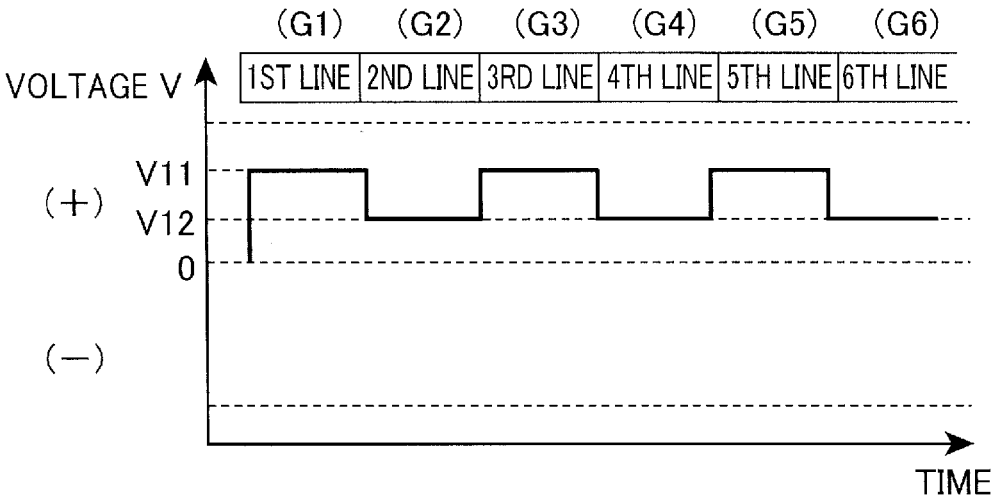
FIG. 9 is a diagram showing a voltage waveform applied to the source signal lines when a gain is set to a gain smaller than the reference gain by the gain setting unit.

FIG. 7 is a diagram showing a state in which white images and black images are alternately displayed on the liquid crystal display panel 12 for each one line in the horizontal direction. FIG. 8 is a diagram showing a voltage waveform applied to the source signal lines when the gain Ga is set to the reference gain Gr by the gain setting unit 24 in the state shown in FIG. 7. FIG. 9 is a diagram showing a voltage waveform applied to the source signal lines when the gain Ga is set to a gain smaller than the reference gain Gr (e.g., Ga=0.5) by the gain setting unit 24. Operations in the first embodiment are described with reference to FIGS. 7 to 9.

As shown in FIG. 7, when white images and black images are alternately displayed on the liquid crystal display panel 12 for each one line in the horizontal direction, a voltage that fluctuates for each one line is applied from the source drive unit 14 to the source signal line S1. When temperature information of the source drive unit 14 acquired by the temperature-information acquiring unit 21 indicates that the temperature of the source drive unit 14 is lower than the reference temperature Tr, the gain setting unit 24 sets the gain Ga to the reference gain Gr. Therefore, an output image signal output from the adder 26 is equal to an input image signal. Therefore, as shown in FIG. 8, a voltage having normal amplitude is applied for each one line from the source drive unit 14 to the source signal line S1. In FIG. 8, V=V1 is applied as a voltage V corresponding to the white images and V=0 is applied as the voltage V corresponding to the black images.

Figure 18:
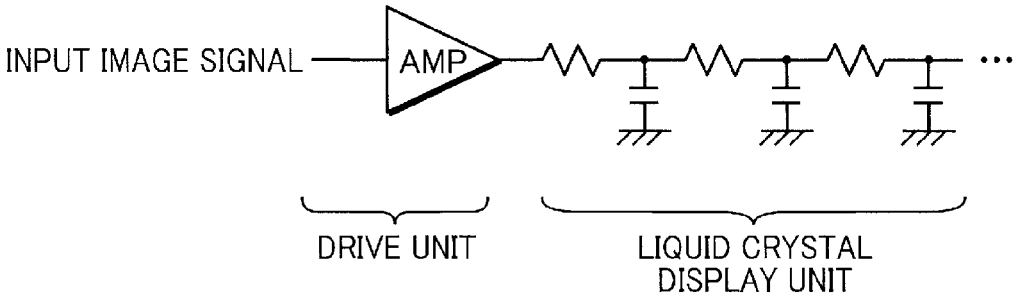
PRIOR ART FIG.18
FIG. 18 is a diagram showing an equivalent circuit of the source signal line.

When the state of FIG. 7 in which the white images and the black images are alternately displayed on the liquid crystal display panel 12 for each one line is continued, charging and discharging of the equivalent capacitors are repeated as described above with reference to FIG. 18. Therefore, the temperature of the source drive unit 14 rises. When the temperature information of the source drive unit 14 acquired by the temperature-information acquiring unit 21 indicates that the temperature of the source drive unit 14 is equal to or higher than the reference temperature Tr, the gain setting unit 24 sets the gain Ga to a value smaller than the reference gain Gr, for example, Ga=0.5. Therefore, the multiplier 25 outputs a value obtained by reducing a high-frequency component in the vertical direction of the input image signal by the gain Ga. As a result, as a voltage applied from the source drive unit 14 to the source signal lines, as shown in FIG. 9, the voltage V corresponding to the white images drops from V=V1 to V=V11 and the voltage V corresponding to the black images rises from V=0 to V=V12. In this way, an applied voltage to the pixels corresponding to the white images drops and an applied voltage to the pixels corresponding to the black images rises. Consequently, the amplitude of the voltage applied to the pixels by the source drive unit 14 is reduced. An average of the applied voltages to the pixels in the case shown in FIG. 8 and an average of the applied voltages to the pixels in the case shown in FIG. 9 change little.

As described above, in the first embodiment, the output image signal is generated using the output value of the high-frequency component of the input image signal from the vertical HPF 23 and the output value of the low-frequency component of the input image signal from the vertical LPF 22. Therefore, when the high-frequency component of the input image signal is large as shown in FIG. 8 for example, it is possible to suitably reduce the amplitude of the applied voltage to the pixels as shown in FIG. 9. On the other hand, when the high-frequency component of the input image signal is close to zero as shown in FIG. 4 for example, the amplitude of the applied voltage to the pixels is hardly reduced. In this way, in the first embodiment, it is possible to suitably control, according to a change in the input image signal, the amplitude of the voltage applied to the pixels by the source drive unit 14. As a result, it is possible to suitably suppress a temperature rise of the source drive unit 14.

In the first embodiment, the output image signal is generated using the value obtained by adding up the value obtained by reducing, by the gain Ga set by the gain setting unit 24, the output value of the high-frequency component of the input image signal from the vertical HPF 23 and the output value of the low-frequency component of the input image signal from the vertical LPF 22. Therefore, it is possible to reduce, with a simple configuration, the amplitude of the applied voltage to the pixels by the source drive unit 14 without changing the configuration of the source drive unit 14.

In the first embodiment, the amplitude of the applied voltage to the pixels is reduced by multiplying the output value of the vertical HPF 23 by the gain Ga. Therefore, the applied voltage to the pixels corresponding to the white images drops and the applied voltage to the pixels corresponding to the black images rises. Therefore, the average of the applied voltages in the case shown in FIG. 8 and the average of the applied voltages in the case shown in FIG. 9 are substantially the same. As a result, since an average of luminance levels does not change, it is possible to suppress deterioration in the display quality of an image.

(Second Embodiment)

Figure 10:
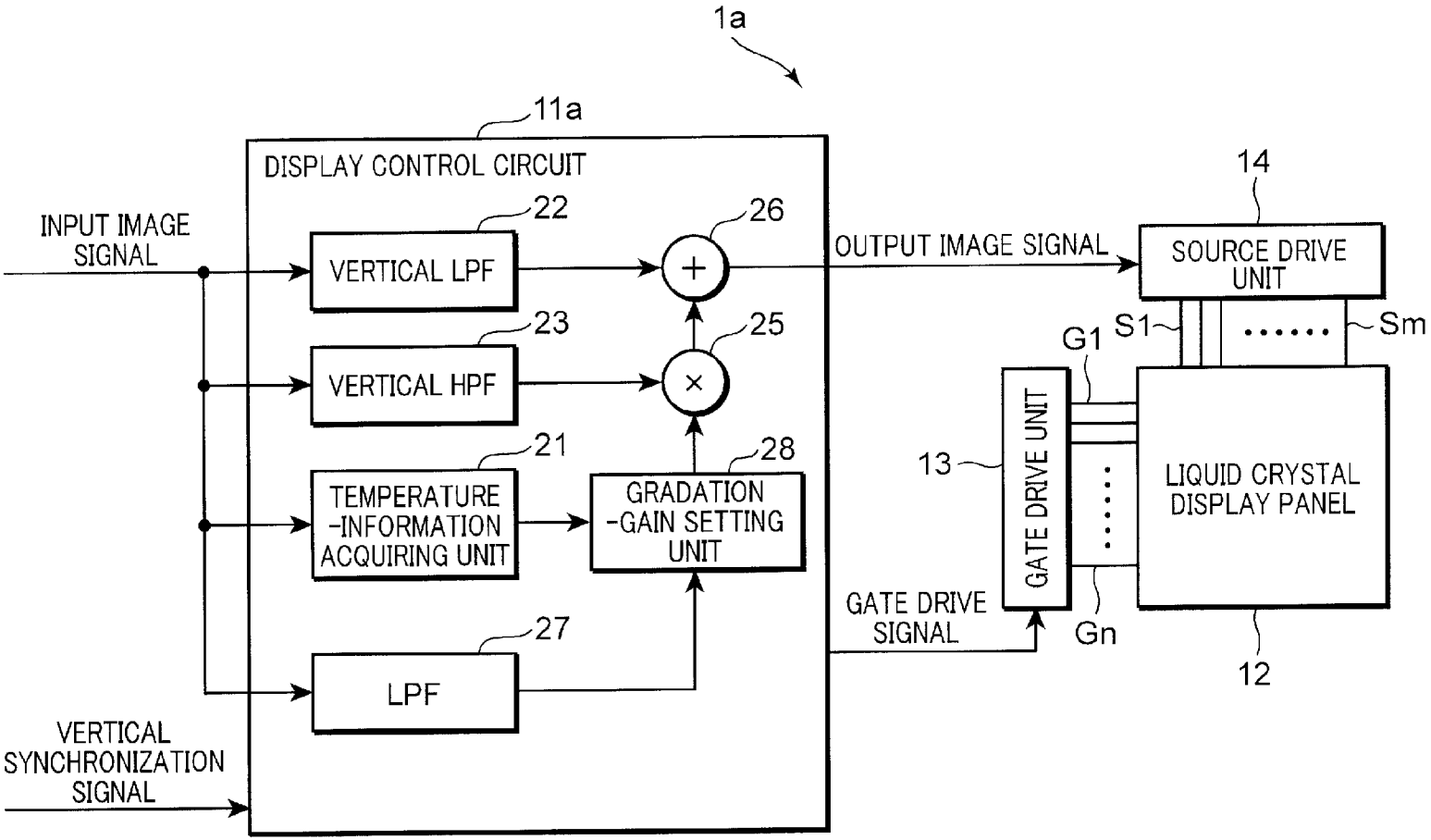
FIG. 10 is a block diagram showing a configuration of a liquid crystal display device according to a second embodiment of the instant application.
Figure 11:
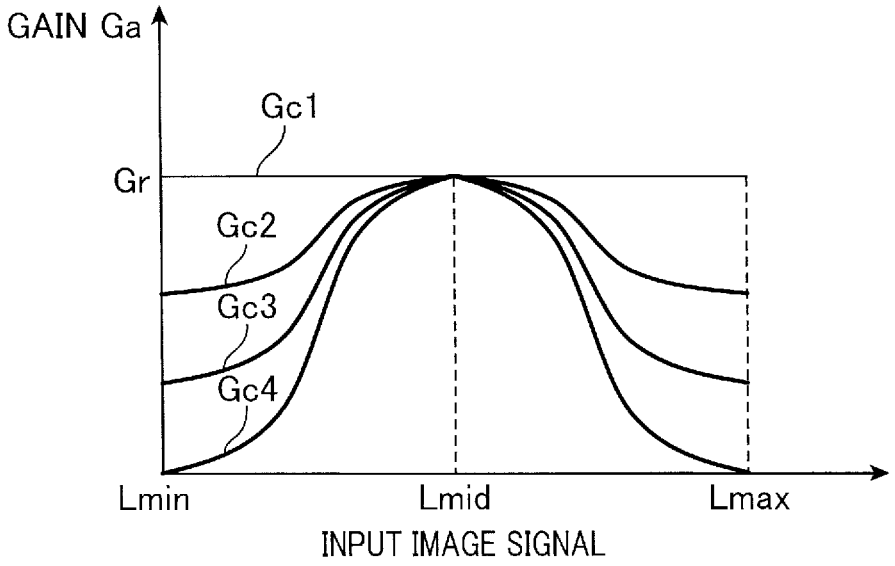
FIG. 11 is a diagram showing an example of a gain curve retained by a gradation-gain setting unit.

FIG. 10 is a block diagram showing a configuration of a liquid crystal display device according to a second embodiment of the instant application. FIG. 11 is a diagram showing an example of a gain curve retained by a gradation-gain setting unit. In the second embodiment, components same as the components in the first embodiment are denoted by the same reference numerals. The second embodiment is described below centering on differences from the first embodiment.

A liquid crystal display device 1*a* according to the second embodiment shown in FIG. 10 includes a display control circuit 11*a* instead of the display control circuit 11 in the liquid crystal display device 1 according to the first embodiment shown in FIG. 1. The display control circuit 11*a* further includes a low-pass filter (LPF) 27, and furthermore includes a gradation-gain setting unit 28 instead of the gain setting unit 24, in the display control circuit 11 shown in FIG. 1.

The LPF 27 extracts a low-frequency component of an input image signal and outputs an average value of signal levels of the input image signal in the vertical direction. The gradation-gain setting unit 28 retains gain curves Gc1 to Gc4 shown in FIG. 11. The gain curves Gc1 to Gc4 are set in advance to correspond to the temperature of the source drive unit 14 and the signal levels of the input image signal.

The gradation-gain setting unit 28 selects the gain curve Gc1 when the temperature T of the source drive unit 14 is in a relation of T<Tr, selects the gain curve Gc2 when the temperature T is in a relation of Tr≤T<T1, selects the gain curve Gc3 when the temperature T is in a relation of T1≤T<T2, and selects the gain curve Gc4 when the temperature T is in a relation of T2≤T<T3, where Tr<T1<T2<T3.

The gain curve Gc1 corresponds to the temperature T of the source drive unit 14 lower than the reference temperature Tr. Therefore, as shown in FIG. 11, the gain of the gain curve Gc1 is a fixed value of the reference gain Gr (e.g., Gr=1) irrespective of a signal level of the input image signal. The gain curves Gc2 to Gc4 are respectively set such that the gain Ga is a minimum value when the signal level of the input image signal is minimum gradation Lmin (Lmin=0 in the case of 8 bits, for example) and maximum gradation Lmax (Lmax=255 in the case of 8 bits, for example), and the gain Ga is a maximum value when the signal level of the input image signal is intermediate gradation Lmid (Lmid=128 in the case of 8 bits, for example). The gain curves Gc2 to Gc4 are set such that the gain Ga is equal to the reference gain Gr when the signal level of the input image signal is the intermediate gradation Lmid.

The gradation-gain setting unit 28 selects, among the gain curves Gc1 to Gc4, a gain curve corresponding to temperature information of the source drive unit 14 output from the temperature-information acquiring unit 21. The gradation-gain setting unit 28 extracts, in the selected gain curve, the gain Ga corresponding to the average of the signal levels of the input image signal output from the LPF 27, and outputs the extracted gain Ga to the multiplier 25. In the second embodiment, the "signal level" of the input image signal is used. However, a "luminance level" of the input image signal may be used. In this embodiment, the liquid crystal display panel 12 corresponds to an example of the liquid crystal display unit, the source drive unit 14 corresponds to an example of the drive unit, the display control circuit 11 corresponds to an example of the control unit, and the vertical LPF 22 and the vertical HPF 23 correspond to an example of the filter unit. In this embodiment, the gradation-gain setting unit 28 corresponds to an example of the gain setting unit, the multiplier 25 corresponding to an example of the multiplying unit, the adder 26 corresponds to an example of the adding unit, the minimum gradation Lmin corresponds to an example of the minimum value of a signal level, the maximum gradation Lmax corresponds to an example of the maximum value of the signal level, and the intermediate gradation Lmid corresponds to an example of the intermediate value of the signal level.

Figure 12:
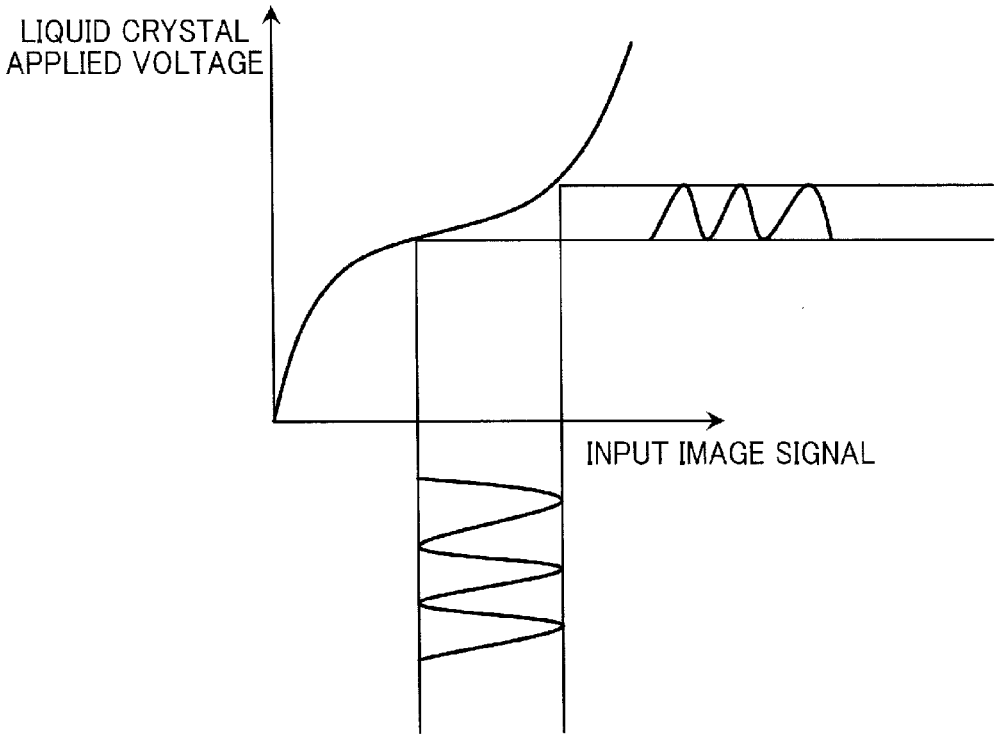
FIG. 12 is a diagram showing an applied voltage characteristic of liquid crystal.

FIG. 12 is a diagram showing an applied voltage characteristic of liquid crystal. An effect of the second embodiment is described with reference to FIG. 12. As shown in FIG. 12, in a region where a signal level of an input image signal is low gradation (low luminance) and high gradation (high luminance), an applied voltage to liquid crystal steeply rises as the signal level of the input image signal increases. On the other hand, in a region where the signal level of the input image signal is intermediate gradation (intermediate luminance), the applied voltage to liquid crystal gently rises as the signal level of the input image signal increases.

Therefore, as shown in FIG. 12, in the region where the signal level of the input image signal is the intermediate gradation, a fluctuation range of the applied voltage to the liquid crystal is small compared with a fluctuation range of the signal level of the input image signal. In other words, when the amplitude of the applied voltage is reduced to reduce the temperature of the source drive unit 14 in the region where the signal level of the input image signal is the intermediate gradation, since the region corresponds to a region where the signal level of the input image signal greatly fluctuates, a decrease in sharpness of an image due to the decrease in the amplitude of the applied voltage is easily visually recognized by an observer. On the other hand, even when the amplitude of the applied voltage is reduced with a gain same as a gain in the region where the signal level of the input image signal is the intermediate gradation in order to reduce the temperature of the source drive unit 14 in the region where the signal level of the input image signal is the low gradation and the high gradation, since the region corresponds to a region where the fluctuation range of the signal level of the input image signal is small, the decrease in the sharpness of the image due to the decrease in the amplitude of the applied voltage is less easily visually recognized by the observer.

When the amplitude of the applied voltage is reduced by reducing an output value of the vertical HPF 23 with the same gain Ga respectively in the region where the signal level of the input image signal is the intermediate gradation and the region where the signal level of the input image signal is the low gradation and the high gradation, as shown in FIG. 12, in the region where the signal level of the input image signal is the intermediate gradation, since the fluctuation range of the applied voltage is small compared with the region where the signal level of the input image signal is the low gradation and the high gradation, a decrease range of the amplitude of the applied voltage is also small. Therefore, in the region where the signal level of the input image signal is the intermediate gradation, an effect of a reduction in temperature by the decrease in the amplitude of the applied voltage is also small compared with the region where the signal level of the input image signal is the low gradation and the high gradation.

Thus, as shown in FIG. 11, the gain curves Gc2 to Gc4 used in the second embodiment are respectively set such that the gain Ga is the minimum value when the signal level of the input image signal is the minimum gradation Lmin and the maximum gradation Lmax, and the gain Ga is the maximum value when the signal level of the input image signal is the intermediate gradation Lmid. In other words, the gain curves Gc2 to Gc4 are set such that the gain Ga is a small value in the vicinity of the minimum gradation Lmin and the maximum gradation Lmax compared with the vicinity of the intermediate gradation Lmid.

As described above, according to the second embodiment, the gain curves Gc2 to Gc4 retained by the gradation-gain setting unit 28 are set such that the gain Ga is a small value in the vicinity of the minimum gradation Lmin and the maximum gradation Lmax compared with the vicinity of the intermediate gradation Lmid. Therefore, it is possible to suppress a temperature rise of the source drive unit 14 by greatly reducing the amplitude of the applied voltage in the region where the signal level of the input image signal is the low gradation and the high gradation and the decrease in the amplitude of the applied voltage to the pixels is less conspicuous. The gain curves Gc2 to Gc4 are set such that the gain Ga is a value close to the reference gain Gr in the vicinity of the intermediate gradation Lmid and, in particular, the gain Ga is a value equal to the reference gain Gr at the intermediate gradation Lmid. Therefore, a decrease range of the amplitude of the applied voltage is small in a region in the vicinity of the intermediate gradation Lmid where the decrease in the sharpness of the image due to the decrease in the amplitude of the applied voltage to the pixels is conspicuous. As a result, it is possible to make the decrease in the sharpness of the image less conspicuous.

(Third Embodiment)

Figure 13:
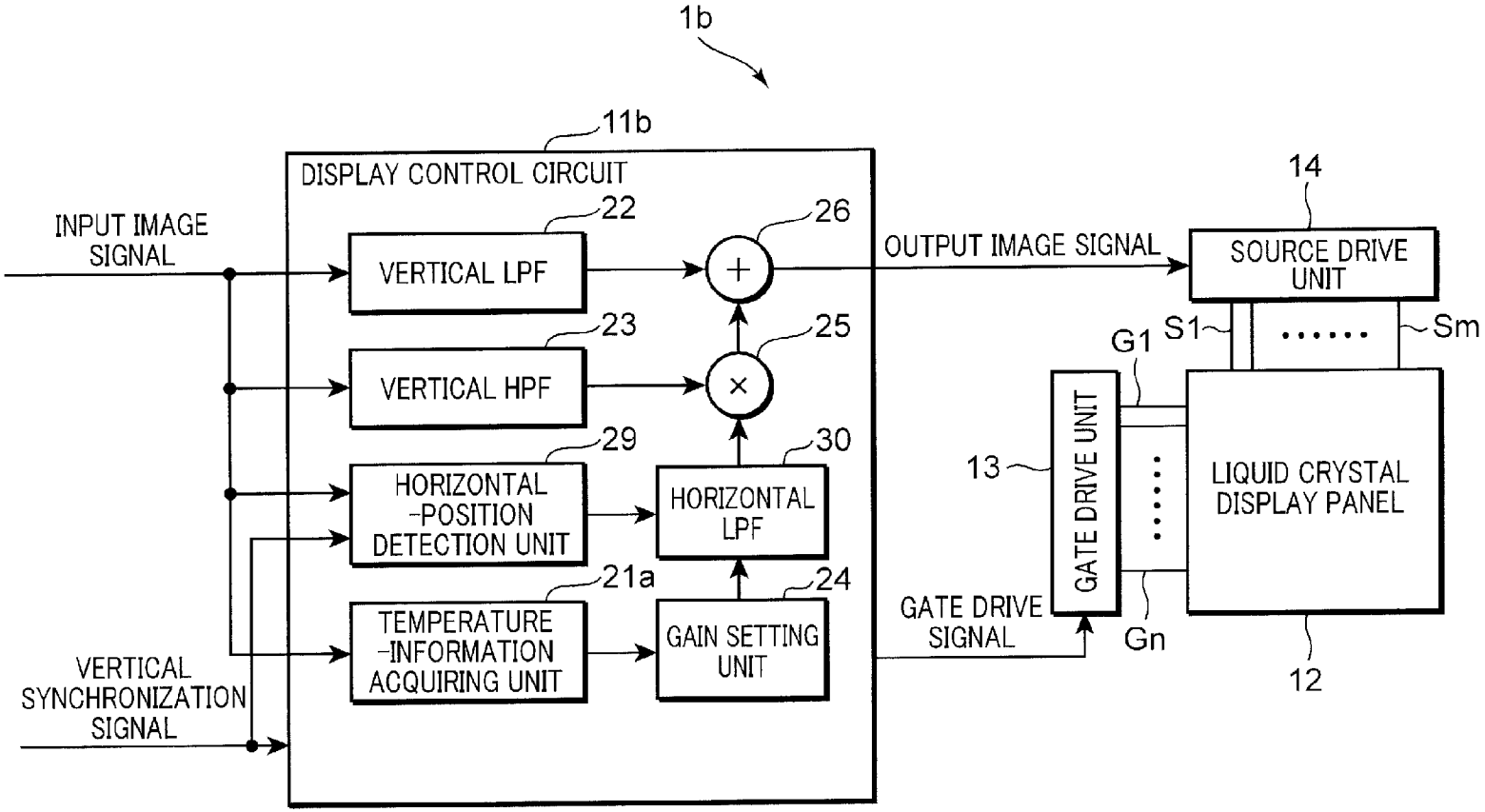
FIG. 13 is a block diagram showing a configuration of a liquid crystal display device according to a third embodiment of the instant application.
Figure 14:
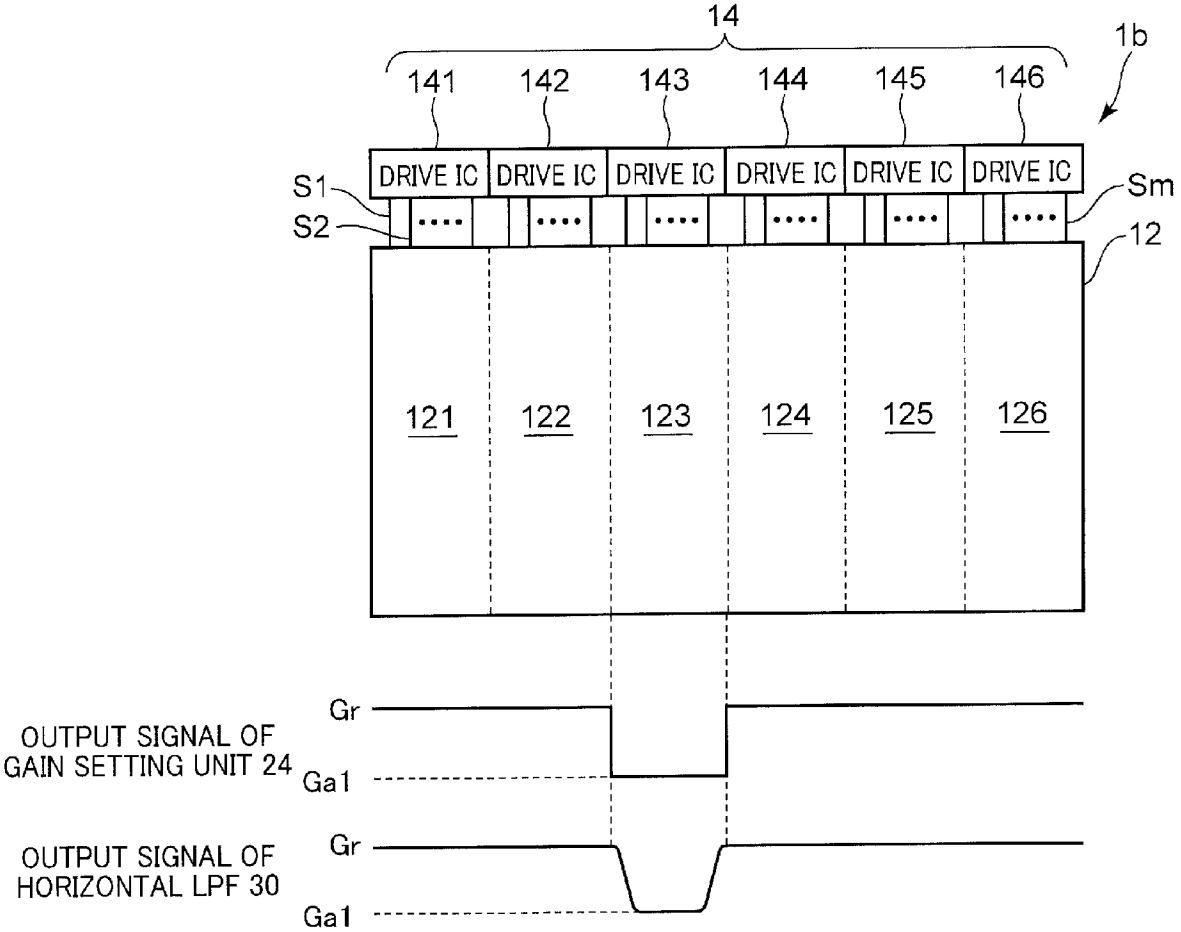
FIG. 14 is a diagram showing a source drive unit and a liquid crystal display panel of the liquid crystal display device according to the third embodiment, and output signals of a gain setting unit and a horizontal LPF.

FIG. 13 is a block diagram showing a configuration of a liquid crystal display device according to a third embodiment of the instant application. FIG. 14 is a diagram showing a source drive unit and a liquid crystal display panel of the liquid crystal display device according to the third embodiment and output signals of a gain setting unit and a horizontal low-pass filter. In the third embodiment, components same as the components in the first embodiment are denoted by the same reference numerals. The third embodiment is described below centering on differences from the first embodiment.

A liquid crystal display device 1*b* according to the third embodiment shown in FIG. 13 includes a display control circuit 11*b* instead of the display control circuit 11 in the liquid crystal display device 1 according to the first embodiment shown in FIG. 1. The display control circuit 11*b* further includes a horizontal-position detection unit 29 and a horizontal low-pass filter (LPF) 30, and furthermore includes a temperature-information acquiring unit 21*a* instead of the temperature-information acquiring unit 21, in the display control circuit 11 shown in FIG. 1.

In the third embodiment, as shown in FIG. 14, the liquid crystal display panel 12 includes regions 121 to 126 divided to respectively include a plurality of source signal lines. The source drive unit 14 includes drive ICs 141 to 146. The drive ICs 141 to 146 respectively correspond to the regions 121 to 126 of the liquid crystal display panel 12 and apply voltages to the source signal lines included in the regions 121 to 126.

The temperature-information acquiring unit 21*a* acquires temperature information for each of the drive ICs 141 to 146 of the source drive unit 14. The horizontal-position detection unit 29 detects, on the basis of an input image signal and a vertical synchronization signal, a horizontal position (a source signal line) of a pixel corresponding to the input image signal. The horizontal LPF 30 reduces, according to the horizontal position detected by the horizontal-position detection unit 29, an inclination of an amount of change (a change ratio) in a gain output from the gain setting unit 24. The display control circuit 11*b* controls each of the drive ICs 141 to 146 in a time division. Alternatively, the display control circuit 11*b* may be provided for each of the drive ICs 141 to 146. In this embodiment, the liquid crystal display panel 12 corresponds to an example of the liquid crystal display unit, the source drive unit 14 corresponds to an example of the drive unit, the display control circuit 11 corresponds to an example of the control unit, and the vertical LPF 22 and the vertical HPF 23 correspond to an example of the filter unit. In this embodiment, the multiplier 25 corresponding to an example of the multiplying unit and the adder 26 corresponds to an example of the adding unit. In this embodiment, the drive ICs 141 to 146 correspond to an example of the drive circuit, the region 123 corresponds to an example of the first region, the region 124 corresponds to an example of the second region, the drive IC 143 corresponds to an example of the first drive circuit, and the drive IC 144 corresponds to an example of the second drive circuit.

Figure 15:
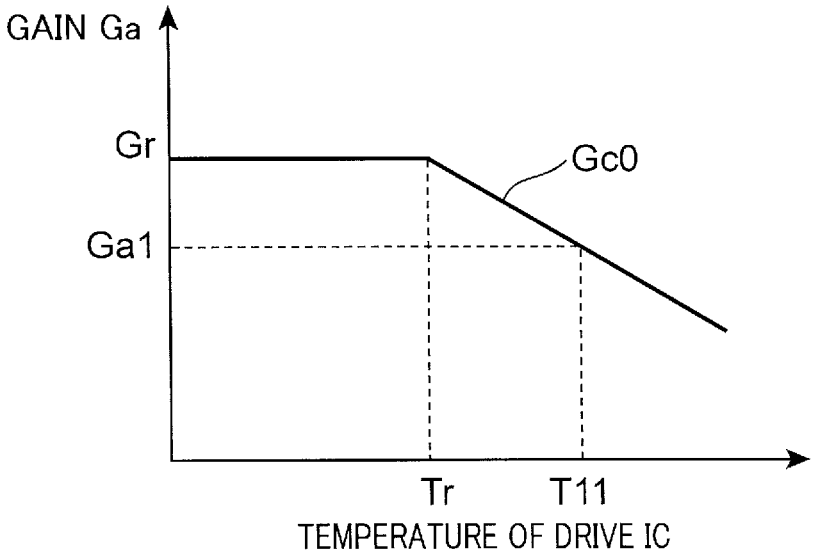
FIG. 15 is a diagram showing a gain curve retained by the gain setting unit in the third embodiment.

FIG. 15 is a diagram showing a gain curve retained by the gain setting unit 24 in the third embodiment. As shown in FIG. 15, the gain setting unit 24 in this embodiment retains the gain curve Gc0 same as the gain curve Gc0 retained by the gain setting unit 24 in the first embodiment shown in FIG. 6. Operations in the third embodiment are described with reference to FIGS. 13 to 15.

Here, it is assumed that the temperature T of the drive ICs 141, 142, and 144 to 146 is lower than the reference temperature Tr (T<Tr) and the temperature T of the drive IC 143 is temperature T11 higher than the reference temperature Tr (T=T11>Tr). In this case, as shown in FIG. 15, the gain setting unit 24 outputs the reference gain Gr as the gain Ga corresponding to the drive ICs 141, 142, and 144 to 146 and outputs a gain Gal (<Gr) as the gain Ga corresponding to the drive IC 143.

Therefore, in an output signal of the gain setting unit 24, as shown in FIG. 14, a signal level corresponding to the drive ICs 141, 142, and 144 to 146 is the reference gain Gr and a signal level corresponding to the drive IC 143 is the gain Gal. Thus, as shown in FIG. 14, the output signal of the gain setting unit 24 is a signal having a waveform that has a large inclination of an amount of change (change ratio) in a gain at a boundary between the drive IC 142 and the drive IC 143 and at a boundary between the drive IC 143 and the drive IC 144.

On the other hand, the horizontal LPF 30 reduces the inclination of the amount of change (the change ratio) in the gain output from the gain setting unit 24 according to the horizontal position detected by the horizontal-position detection unit 29. Therefore, as shown in FIG. 14, an output signal of the horizontal LPF 30 is a signal having a waveform reduced in the inclination of the amount of change (the change ratio) in the gain.

As described above, in the third embodiment, the inclination of the amount of change (the change ratio) in the gain is reduced by the horizontal LPF 30 in a boundary portion between the drive ICs 142 and 143 and a boundary portion between the drive ICs 143 and 144 where the gain output from the gain setting unit 24 changes. When the gain suddenly changes in a boundary portion between the drive ICs, it is likely that a change in sharpness of an image in the boundary portion is visually recognized by the observer. On the other hand, according to the third embodiment, the inclination of the amount of change (the change ratio) in the gain is reduced in a boundary portion of the drive ICs. Therefore, it is possible to prevent a change in sharpness of an image in the boundary portion from being visually recognized by the observer.

(Others)

Figure 16:
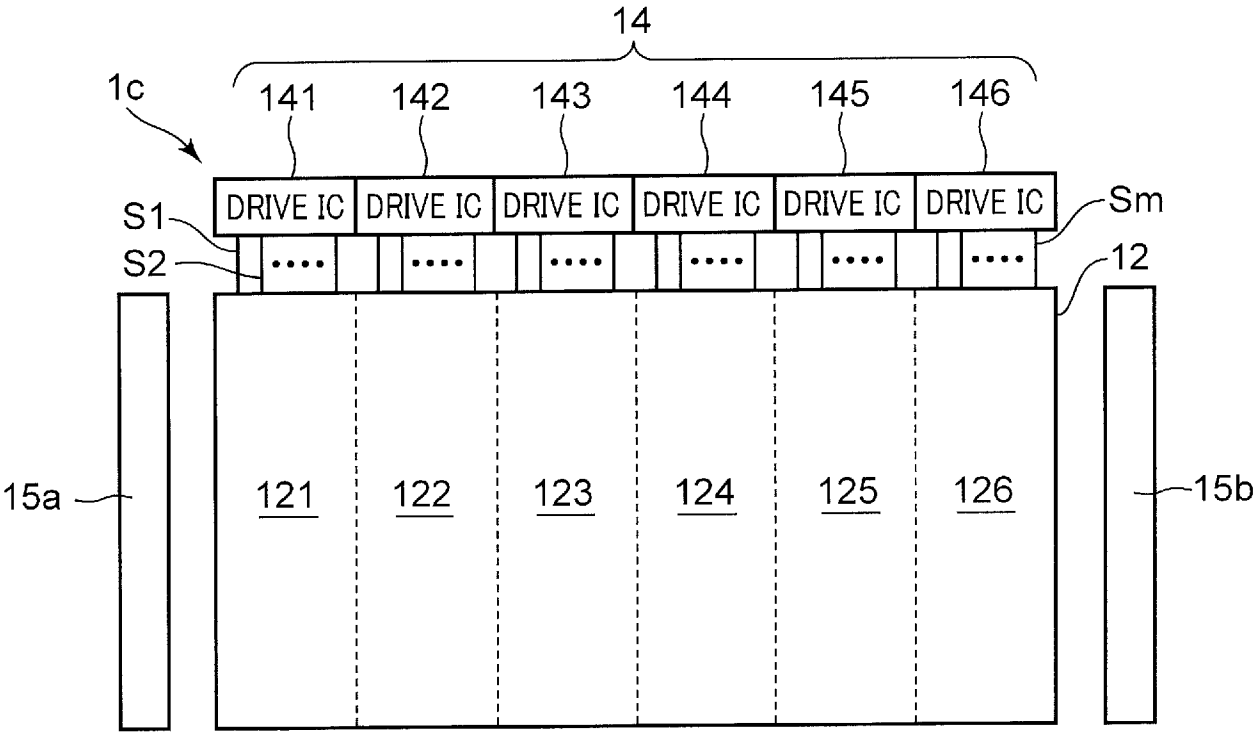
FIG. 16 is a diagram showing a liquid crystal display device of an edge light system including backlights on the right and left of the liquid crystal display panel in the liquid crystal display device according to the third embodiment.

FIG. 16 is a diagram showing a liquid crystal display device of an edge light system including backlights on the left and the right of the liquid crystal display panel in the liquid crystal display device according to the third embodiment. A liquid crystal display device 1*c* shown in FIG. 16 includes backlights 15*a* and 15*b* respectively on the left and the right of the liquid crystal display panel 12. The backlights 15*a* and 15*b* include, for example, LEDs. The liquid crystal display device 1*c* shown in FIG. 16 has the same configuration as the liquid crystal display device 1*b* according to the third embodiment except that the liquid crystal display device 1*c* includes the backlights 15*a* and 15*b*.

In an embodiment shown in FIG. 16, the temperature of the drive ICs 141 and 146 respectively close to the backlights 15*a* and 15*b* often rises compared with the other drive ICs 142 to 145 because of heat generation of the backlights 15*a* and 15*b*. The gain setting unit 24 retains, as gain curves of the drive ICs 141 and 146, gain curves set to be lower than gain curves of the other drive ICs 142 to 145 assuming in advance that the temperature of the drive ICs 141 and 146 rises. A decrease in sharpness of an image due to a reduction in voltage amplitude at the left and right edges of a screen of the liquid crystal display panel 12 is less conspicuous compared with that in the center of the screen. Therefore, according to this embodiment, it is possible to suppress a temperature rise of the drive ICs 141 and 146, without making the decrease in the sharpness of the image conspicuous.

In the embodiments described above, as shown in FIG. 2, the pixels of the same colors are connected to the respective source signal lines. For example, in FIG. 2, the red pixels R are connected to the source signal line S1, the green pixels G are connected to the source signal line S2, and the blue pixels B are connected to the source signal line S3. However, a connection configuration of the pixels to the source signal lines is not limited to this.

Figure 17:
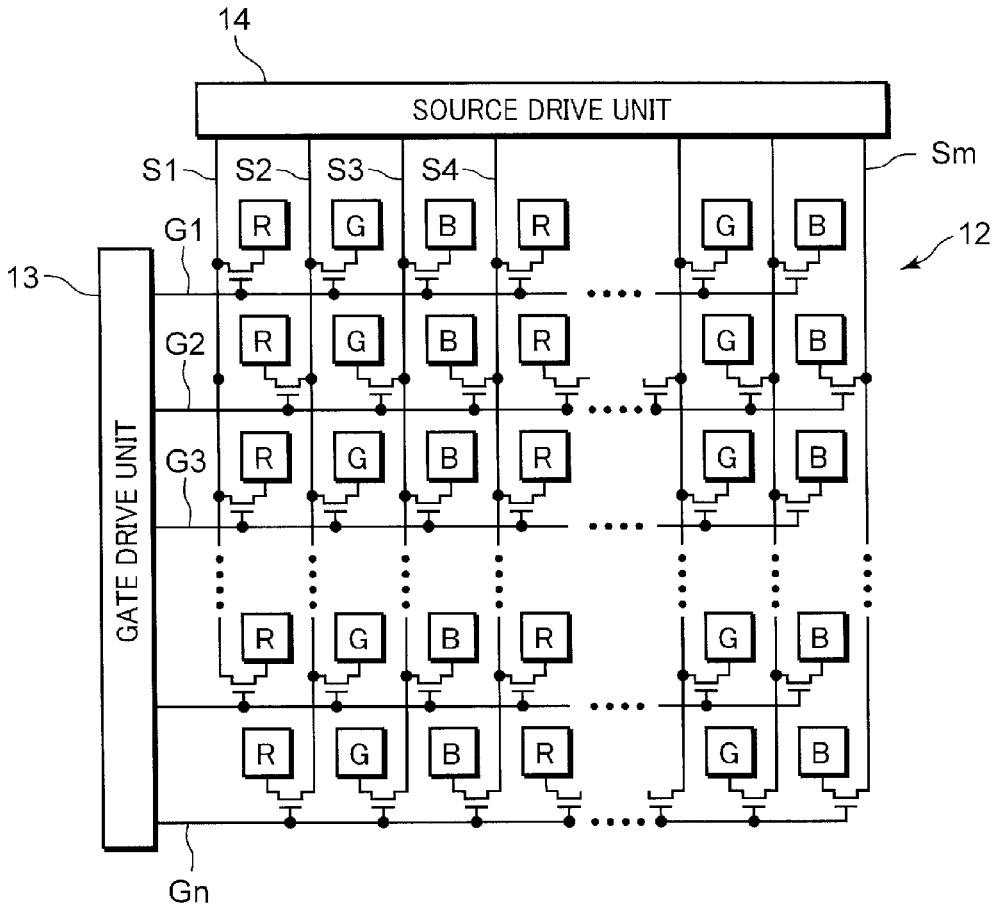
FIG. 17 is a diagram showing a different connection configuration of thin-film transistors and pixels with respect to source signal lines.

FIG. 17 is a diagram showing a different connection configuration of the thin-film transistors Q and the pixels R, G, and B to the source signal lines. In this configuration, pixels of different colors are alternately connected to the respective source signal lines. For example, in FIG. 17, the green pixel G, the red pixel R, the green pixel G, and the like are connected to the source signal line S2 in order from the top, the blue pixel B, the green pixel G, the blue pixel B, and the like are connected to the source signal line S3 in order from the top, and the red pixel R, the blue pixel B, the red pixel R, and the like are connected to the source signal line S4 in order from the top. In the connection configuration shown in FIG. 17, when a white image is displayed on the entire surface of the liquid crystal display panel 12, a voltage applied to the source signal lines is the voltage signal shown in FIG. 4. Therefore, the embodiments described above can be applied in the same manner in the liquid crystal display panel having the connection configuration shown in FIG. 17.

The specific embodiments described above mainly include the liquid crystal display device configured as described below.

In one general aspect, the instant application describes a liquid crystal display device that includes: a liquid crystal display unit that includes a plurality of source signal lines, a plurality of gate signal lines, and a plurality of pixels connected to the source signal lines and the gate signal lines, and displays, for each of frames, an image based on an input image signal; a drive unit that applies a voltage based on the input image signal to the plurality of pixels of the liquid crystal display unit; and a control unit that controls an amplitude of the voltage applied to the plurality of pixels by the drive unit. The drive unit applies, in one of the frames, a voltage of the same polarity to the plurality of pixels connected to one of the source signal lines, the control unit includes: a temperature-information acquiring unit that acquires temperature information corresponding to a temperature of the drive unit; and a filter unit that acquires a high-frequency component of the input image signal in a substantial extending direction of the source signal lines, and the control unit controls the amplitude of the voltage applied to the plurality of pixels by the drive unit using the temperature information of the drive unit acquired by the temperature-information acquiring unit and an output value of the high-frequency component acquired by the filter unit.

According to this configuration, the liquid crystal display unit includes the plurality of source signal lines, the plurality of gate signal lines, and the plurality of pixels connected to the source signal lines and the gate signal lines. The liquid crystal display unit displays, for each of the frames, the image based on the input image signal. The drive unit applies the voltage based on the input image signal to the plurality of pixels of the liquid crystal display unit. The control unit controls the amplitude of the voltage applied to the plurality of pixels by the drive unit. The drive unit applies, in one of the frames, the voltage of the same polarity to the plurality of pixels connected to one of the source signal lines. The temperature-information acquiring unit acquires temperature information corresponding to the temperature of the drive unit. The filter unit acquires the high-frequency component of the input image signal in the substantial extending direction of the source signal lines. The control unit controls the amplitude of the voltage applied to the plurality of pixels by the drive unit using the temperature information of the drive unit acquired by the temperature-information acquiring unit and the output value of the high-frequency component acquired by the filter unit. Therefore, since the output value of the high-frequency component of the input image signal is used, it is possible to suitably control the amplitude of the applied voltage to the pixels according to a change in the input image signal. Further, since the filter unit that acquires the high-frequency component and the low-frequency component of the input image signal in the substantial extending direction of the source signal lines is used, there is an advantage that it is unnecessary to change the configuration of the drive unit.

The above general aspect may include one or more of the following features. The control unit may further include a gain setting unit that sets a gain on the basis of the temperature information of the drive unit acquired by the temperature-information acquiring unit, and the control unit controls, in a case where the temperature information of the drive unit acquired by the temperature-information acquiring unit indicates that the temperature of the drive unit is equal to or higher than a predetermined reference temperature, the amplitude of the voltage applied to the plurality of pixels by the drive unit using a value obtained by reducing, by the gain set by the gain setting unit, the output value of the high-frequency component acquired by the filter unit.

According to this configuration, the gain setting unit sets a gain on the basis of the temperature information of the drive unit acquired by the temperature-information acquiring unit. The control unit controls, in a case where the temperature information of the drive unit acquired by the temperature-information acquiring unit indicates that the temperature of the drive unit is equal to or higher than a predetermined reference temperature, the amplitude of the voltage applied to the plurality of pixels by the drive unit using a value obtained by reducing, by the gain set by the gain setting unit, the output value of the high-frequency component acquired by the filter unit. Therefore, since the value obtained by reducing, by the set gain, the output value of the high-frequency component of the input image signal is used, when a change in the input image signal is large, it is possible to suitably reduce the amplitude of the voltage applied to the pixels by the drive unit. As a result, it is possible to suitably reduce the temperature of the drive unit.

The filter unit may further acquire a low-frequency component of the input image signal in the substantial extending direction of the source signal lines, the control unit may further include: a multiplying unit that outputs a multiplication result obtained by multiplying the output value of the high-frequency component acquired by the filter unit by the gain set by the gain setting unit; and an adding unit that outputs an addition result obtained by adding an output value of the multiplying unit and an output value of the low-frequency component acquired by the filter unit, and the control unit controls, on the basis of an output value of the adding unit, the amplitude of the voltage applied to the plurality of pixels by the drive unit.

According to this configuration, the filter unit further acquires the low-frequency component of the input image signal in the substantial extending direction of the source signal lines. The multiplying unit outputs the multiplication result obtained by multiplying the output value of the high-frequency component acquired by the filter unit by the gain set by the gain setting unit. The adding unit outputs the addition result obtained by adding the output value of the multiplying unit and the output value of the low-frequency component acquired by the filter unit. The control unit controls, on the basis of the output value of the adding unit, the amplitude of the voltage applied to the plurality of pixels by the drive unit. In this way, the amplitude of the voltage applied to the plurality of pixels by the drive unit is controlled based on the addition result obtained by adding the output value of the multiplying unit and the output value of the low-frequency component acquired by the filter unit. Therefore, it is possible to control, with a simple configuration, the amplitude of the voltage applied to the pixels.

The gain setting unit may set the gain to a reference gain, in a case where the temperature information of the drive unit acquired by the temperature-information acquiring unit indicates that the temperature of the drive unit is lower than the reference temperature, and the reference gain is set such that the output value of the adding unit is equal to the input image signal.

According to this configuration, the gain setting unit sets the gain to a reference gain, in a case where the temperature information of the drive unit acquired by the temperature-information acquiring unit indicates that the temperature of the drive unit is lower than the reference temperature. The reference gain is set such that the output value of the adding unit is equal to the input image signal. Therefore, in a case where the temperature of the drive unit is lower than the reference temperature, it is possible to prevent, with a simple configuration, the amplitude of the voltage from decreasing.

The signal level of the input image signal is a value in a range from a predetermined minimum value to a predetermined maximum value, and the gain setting unit may set, in a case where the temperature information of the drive unit acquired by the temperature-information acquiring unit indicates that the temperature of the drive unit is equal to or higher than the reference temperature, the gain to a small value when the signal level of the input image signal is in a vicinity of the minimum value or in a vicinity of the maximum value, compared with a value set when the signal level of the input image signal is an intermediate value between the minimum value and the maximum value.

According to this configuration, the signal level of the input image signal is the value in the range from the predetermined minimum value to the predetermined maximum value. The gain setting unit sets, in a case where the temperature information of the drive unit acquired by the temperature-information acquiring unit indicates that the temperature of the drive unit is equal to or higher than the reference temperature, the gain to a small value when the signal level of the input image signal is in a vicinity of the minimum value or in a vicinity of the maximum value, compared with a value set when the signal level of the input image signal is the intermediate value between the minimum value and the maximum value.

As a characteristic of the applied voltage to the liquid crystal, the liquid crystal has a characteristic that the applied voltage to the liquid crystal steeply rises as the signal level of the input image signal increases in the region where the signal level of the input image signal is in the vicinity of the minimum value and in the region where the signal level of the input image signal is in the vicinity of the maximum value, and that the applied voltage to the liquid crystal gently rises as the signal level of the input image signal increases in the region where the signal level of the input image signal is the intermediate value between the minimum value and the maximum value. Therefore, in the region where the signal level of the input image signal is the intermediate value, a fluctuation range of the applied voltage to the liquid crystal is small compared with a fluctuation range of the signal level of the input image signal. In other words, when the amplitude of the applied voltage is reduced in the region where the signal level of the input image signal is the intermediate value, since the region corresponds to a region where the signal level of the input image signal substantially fluctuates, the decrease in the amplitude of the applied voltage is easily visually recognized by an observer. On the other hand, even when the amplitude of the applied voltage is reduced in the region where the signal level of the input image signal is in the vicinity of the minimum value and in the vicinity of the maximum value, since the region corresponds to a region where the fluctuation range of the signal level of the input image signal is small, the decrease in the amplitude of the applied voltage is less easily visually recognized by the observer.

Therefore, according to the configuration described above, the gain is set to a small value when the signal level of the input image signal is in the vicinity of the minimum value or in the vicinity of the maximum value, compared with a value set when the signal level of the input image signal is the intermediate value between the minimum value and the maximum value. Therefore, it is possible to reduce the amplitude of the voltage applied to the pixels by the drive unit, when the signal level of the input image signal is in the vicinity of the minimum value or in the vicinity of the maximum value where the decrease in the amplitude of the applied voltage is less easily visually recognized. As a result, it is possible to suitably reduce the temperature of the drive unit.

The liquid crystal display unit may include a plurality of regions divided to respectively include a plurality of the source signal lines, the drive unit includes a plurality of drive circuits that respectively apply the voltage based on the input image signal to the pixels, one of the drive circuits applies the voltage to a plurality of the pixels included in one of the regions corresponding to the drive circuit, the temperature-information acquiring unit acquires the temperature information for each of the drive circuits, and the control unit controls, for each of the drive circuits, the amplitude of the voltage applied to the plurality of the pixels included in the region corresponding to the drive circuit, using the temperature information acquired by the temperature-information acquiring unit for each of the drive circuits.

According to this configuration, the liquid crystal display unit includes the plurality of regions divided to respectively include the plurality of the source signal lines. The drive unit includes the plurality of drive circuits that respectively apply the voltage based on the input image signal to the pixels. One of the drive circuits applies the voltage to the plurality of the pixels included in one of the regions corresponding to the drive circuit. The temperature-information acquiring unit acquires the temperature information for each of the drive circuits. The control unit controls, for each of the drive circuits, the amplitude of the voltage applied to the plurality of the pixels included in the region corresponding to the drive circuit, using the temperature information acquired by the temperature-information acquiring unit for each of the drive circuits. Therefore, it is possible to finely control, for each of the drive circuits, the amplitude of the applied voltage to the pixels.

The liquid crystal display unit may include, as the regions, a first region and a second region adjacent to the first region, the drive unit includes, as the drive circuits, a first drive circuit that applies the voltage to a plurality of the pixels included in the first region and a second drive circuit that applies the voltage to a plurality of the pixels included in the second region, and the control unit controls, in a case where the temperature information acquired by the temperature-information acquiring unit indicates that a temperature of the first drive circuit is equal to or higher than the reference temperature and a temperature of the second drive circuit is lower than the reference temperature, the first drive circuit such that an amplitude of the voltage applied by the first drive circuit to the pixels included in the first region decreases and a decrease amount of an amplitude of the voltage applied to the pixels in a vicinity of a boundary between the first region and the second region among the pixels included in the first region is small compared with a decrease amount of an amplitude of the voltage applied to the pixels at a location away from the vicinity of the boundary between the first region and the second region among the pixels included in the first region.

According to this configuration, the liquid crystal display unit includes, as the regions, the first region and the second region adjacent to the first region. The drive unit includes, as the drive circuits, the first drive circuit that applies the voltage to the plurality of the pixels included in the first region and the second drive circuit that applies the voltage to the plurality of the pixels included in the second region. The control unit controls, in a case where the temperature information acquired by the temperature-information acquiring unit indicates that the temperature of the first drive circuit is equal to or higher than the reference temperature and the temperature of the second drive circuit is lower than the reference temperature, the first drive circuit such that the amplitude of the voltage applied by the first drive circuit to the pixels included in the first region decreases and the decrease amount of the amplitude of the voltage applied to the pixels in the vicinity of the boundary between the first region and the second region among the pixels included in the first region is small compared with the decrease amount of the amplitude of the voltage applied to the pixels at the location away from the vicinity of the boundary between the first region and the second region among the pixels included in the first region. Therefore, it is possible to make a change in an image due to the decrease in the amplitude of the voltage applied to the pixels by the first drive circuit less conspicuous in the vicinity of the boundary between the first region and the second region.

INDUSTRIAL APPLICABILITY

A liquid crystal display device that displays, for each of frames, an image based on an input image signal on a liquid crystal display unit is useful as a liquid crystal display device that can control, with a simple configuration, an applied voltage from a drive unit to pixels.

This application is based on Japanese Patent application No. 2011-288298 filed in Japan Patent Office on Dec. 28, 2011, the contents of which are hereby incorporated by reference.

Although the present application has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A liquid crystal display device comprising:

a liquid crystal display unit that includes a plurality of source signal lines, a plurality of gate signal lines, and a plurality of pixels connected to the source signal lines and the gate signal lines, and displays, for each of frames, an image based on an input image signal;

a source drive unit that applies a voltage based on the input image signal to the plurality of pixels of the liquid crystal display unit; and a control unit that controls an amplitude of the voltage applied to the plurality of pixels by the source drive unit, wherein the source drive unit applies, in one of the frames, a voltage of the same polarity to the plurality of pixels connected to one of the source signal lines, the control unit includes:

a temperature-information acquiring unit that acquires temperature information corresponding to a temperature of the source drive unit;

a filter unit that acquires, from the input image signal, (i) a high-frequency component in a first direction and (ii) a low-frequency component in the first direction, the frist direction being a direction which is substantially the same as a direction in which the source signal lines extend;

a gain setting unit that sets a gain on the basis of the temperature information of the source drive unit acquired by the temperature-information acquiring unit;

a multiplying unit that outputs a multiplication result obtained by multiplying (i) the output value of the high-frequency component acquired by the filter unit by (ii) the gain set by the gain setting unit; and an adding unit that outputs an addition result obtained by adding (i) an output value of the multiplying unit and (ii) an output value of the low-frequency component acquired by the filter unit, the control unit controls, on the basis of the output value of the adding unit, the amplitude of the voltage applied to the plurality of pixels by the source drive unit, the signal level of the input image signal is a value in a range from a predetermined minimum value to a predetermined maximum value, the gain setting unit sets the gain to a value that is not more than 1, in a case where the temperature information of the source drive unit acquired by the temperature-information acquiring unit indicates that the temperature of the source drive unit is equal to or higher than the reference temperature, the gain setting unit sets the gain to a small value when the signal level of the input image signal is in a vicinity of the minimum value or in a vicinity of the maximum value, compared with a value set when the signal level of the input image signal is an intermediate value between the minimum value and the maximum value, and the control unit reduces, by using the gain set by the gain setting unit, the amplitude of the applied voltage more when the signal level of the input image signal is in the vicinity of the minimum value or in the vicinity of the maximum value than when the signal level of the input image signal is the intermediate value between the minimum value and the maximum value.

2. The liquid crystal display device according to claim 1, wherein the gain setting unit sets the gain to a reference gain, in a case where the temperature information of the source drive unit acquired by the temperature-information acquiring unit indicates that the temperature of the source drive unit is lower than the reference temperature, and the reference gain is set such that the output value of the adding unit is equal to the input image signal.

3. The liquid crystal display device according to claim 1, wherein the liquid crystal display unit includes a plurality of regions divided to respectively include a plurality of the source signal lines, the source drive unit includes a plurality of source drive circuits that respectively apply the voltage based on the input image signal to the pixels, one of the source drive circuits applies the voltage to a plurality of the pixels included in one of the regions corresponding to the source drive circuit, the temperature-information acquiring unit acquires the temperature information for each of the source drive circuits, and the control unit controls, for each of the source drive circuits, the amplitude of the voltage applied to the plurality of the pixels included in the region corresponding to the source drive circuit, using the temperature information acquired by the temperature-information acquiring unit for each of the source drive circuits.

4. The liquid crystal display device according to claim 3, wherein the liquid crystal display unit includes, as the regions, a first region and a second region adjacent to the first region, the source drive unit includes, as the source drive circuits, a first source drive circuit that applies the voltage to a plurality of the pixels included in the first region and a second source drive circuit that applies the voltage to a plurality of the pixels included in the second region, and the control unit controls, in a case where the temperature information acquired by the temperature-information acquiring unit indicates that a temperature of the first source drive circuit is equal to or higher than the reference temperature and a temperature of the second source drive circuit is lower than the reference temperature, the first source drive circuit such that an amplitude of the voltage applied by the first source drive circuit to the pixels included in the first region decreases and a decrease amount of an amplitude of the voltage applied to the pixels in a vicinity of a boundary between the first region and the second region among the pixels included in the first region is small compared with a decrease amount of an amplitude of the voltage applied to the pixels at a location away from the vicinity of the boundary between the first region and the second region among the pixels included in the first region.

5. The liquid crystal display device according to claim 1, wherein the temperature-information acquiring unit includes a temperature sensor that detects the temperature of the source drive unit, and wherein the temperature-information acquiring unit acquires the detected temperature of the source drive unit as the temperature information.

* * * * *